US009604119B2

(12) United States Patent
Kronzer

(10) Patent No.: US 9,604,119 B2
(45) **Date of Patent: *Mar. 28, 2017**

(54) GOLF ALIGNMENT ROD HOLDER

(71) Applicant: Corey Kronzer, Houston, TX (US)

(72) Inventor: Corey Kronzer, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/210,195

(22) Filed: Mar. 13, 2014

(65) Prior Publication Data

US 2015/0258411 A1 Sep. 17, 2015

Related U.S. Application Data

(60) Provisional application No. 61/780,605, filed on Mar. 13, 2013.

(51) Int. Cl.
*A63B 69/36* (2006.01)
*A63B 71/02* (2006.01)

(52) U.S. Cl.
CPC .... *A63B 69/3641* (2013.01); *A63B 2071/026* (2013.01); *A63B 2210/50* (2013.01)

(58) Field of Classification Search
USPC ..... 473/218, 257, 266, 271, 272, 274
See application file for complete search history.

(56) References Cited

U.S. PATENT DOCUMENTS

| | | | | |
|---|---|---|---|---|
| 3,443,811 | A * | 5/1969 | Brooks | 473/274 |
| 4,718,674 | A * | 1/1988 | Henry | 473/218 |
| 5,013,044 | A * | 5/1991 | Hesselbart | 473/218 |
| 5,303,926 | A * | 4/1994 | Owens et al. | 473/261 |
| 5,599,240 | A * | 2/1997 | Feldmeier | 473/218 |
| 5,616,085 | A * | 4/1997 | LaCoste et al. | 473/267 |
| 6,346,050 | B1 * | 2/2002 | Larson | 473/270 |
| 6,988,957 | B2 * | 1/2006 | Bender | 473/266 |
| 7,431,661 | B1 * | 10/2008 | Cailey | 473/257 |
| 8,696,484 | B2 * | 4/2014 | Shahi et al. | 473/257 |
| 8,715,100 | B1 * | 5/2014 | Petroske et al. | 473/274 |
| 2012/0122602 | A1 * | 5/2012 | Whitt et al. | 473/274 |
| 2014/0287850 | A1 * | 9/2014 | Kronzer | 473/272 |

* cited by examiner

*Primary Examiner* — Nini Legesse
(74) *Attorney, Agent, or Firm* — Patterson & Sheridan, LLP

(57) ABSTRACT

Embodiments of the invention include an alignment rod holder that holds an alignment rod at different angles to provide reference points and feedback for golf practice drills. The device is comprised of a centerpiece, which holds the alignment rod, and two base pieces.

15 Claims, 7 Drawing Sheets

FIG. 1
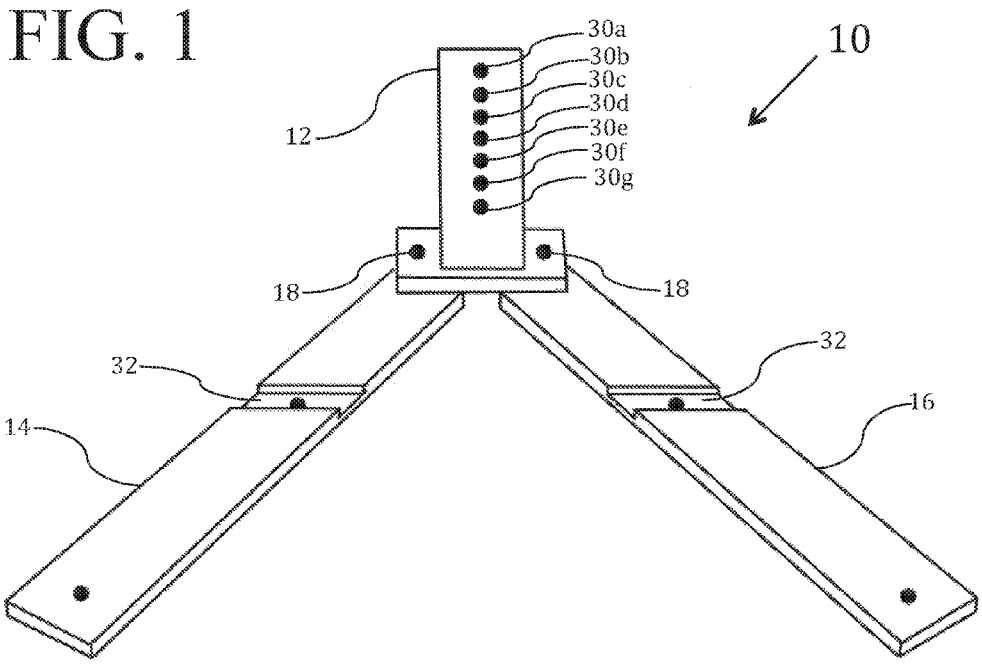
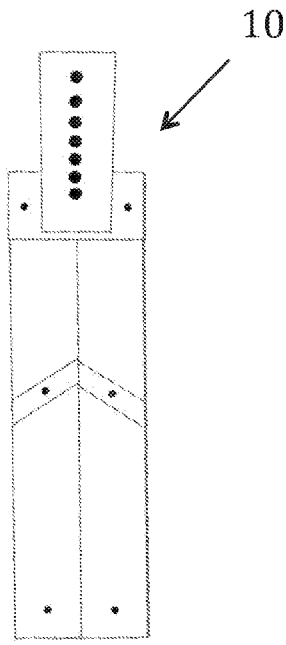
FIG. 2

GOLF ALIGNMENT ROD HOLDER

CROSS-REFERENCE TO RELATED APPLICATIONS

This application claims benefit of U.S. provisional patent application Ser. No. 61/780,605, filed Mar. 13, 2013, which is herein incorporated by reference.

FIELD OF THE INVENTION

Embodiments of the invention relate to golf aids. More specifically, embodiments relate to golf alignment rod holders.

BACKGROUND OF THE INVENTION

Alignment rods are simple, effective, and affordable training aids that are used by a golfer in drills to practice virtually every aspect of the game of golf. All the drills that can be performed with alignment rods are relatively simple to setup and perform. These drills require the alignment rods to be put at different angles or positions on the ground, on a golf club, somewhere on the golfer's body, in the ground, or a combination of these.

The main drawback about some of these drills is that they have to be performed on a surface that allows a golfer to insert an alignment rod into the ground at an angle. This usually means a golfer can only perform these drills when practicing on grass.

Depending on the hardness/softness of the ground, it can be difficult to achieve the desired alignment rod angle. If the ground is too soft the alignment rod will not be stable, and if it is too hard then it is difficult to insert the alignment rod. In grass, once the alignment rod is setup, the rod may need to be moved and reinserted after multiple swings due to the fact that a divot might have been taken. This would require the golfer to shift to a new spot to hit the next ball, which may change the original intended setup of the alignment rod.

Golfers who do not have access to grass practice areas or who desire faster setup time for drills that require the insertion of alignment rods into the ground need a simple, effective, and portable device which allows the execution of these drills; either for efficiency or on surfaces that prohibit the insertion of alignment rods.

BRIEF SUMMARY OF THE INVENTION

Embodiments of the present invention include a portable, simple, and functional holder of an alignment rod for a golfer's practice drills.

One aspect of the present invention provides a holder that can securely hold an alignment rod at different angles, without any anchoring or attachment to the ground or any other object, and, when broken down, can be easily stowed. The device includes a centerpiece and two base pieces.

Depending on the drill being performed, the golfer inserts an alignment rod into the hole in the centerpiece that matches the desired angle.

Another aspect of the present invention provides a device that allows a golfer to perform drills, which formally required an alignment rod to be inserted into the playing surface, even when the surface prohibits the insertion of an alignment rod into them. For example, driving range mats, carpet, hard woods, packed dirt, and hard ground.

Another aspect of the present invention is it provides a holder that simplifies the setup for drills. When the position of the alignment rod needs to be changed due to ball positioning, the golfer can simply move the device and the desired angle is reestablished.

The above aspects, and others, will be better understood after a reading of the following description and accompanying drawings.

BRIEF DESCRIPTION OF THE DRAWINGS

FIG. 1 is a photo of the alignment rod holder.

FIG. 2 is a photo of the alignment rod holder shown in FIG. 1 with the legs folded in.

FIG. 5 is a photo of the alignment rod holder shown in FIG. 4 with the legs folded in.

FIG. 6 is a photo of the side of the alignment rod holder shown in FIG. 4 with the legs folded in.

DETAILED DESCRIPTION

Figure 4:
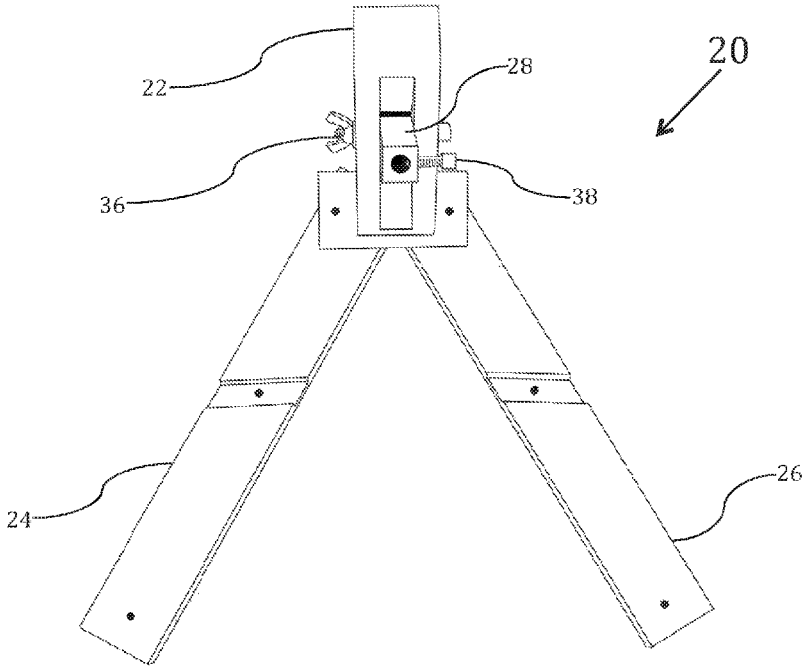
FIG. 4 is a photo of another alignment rod holder shown.
Figure 5:
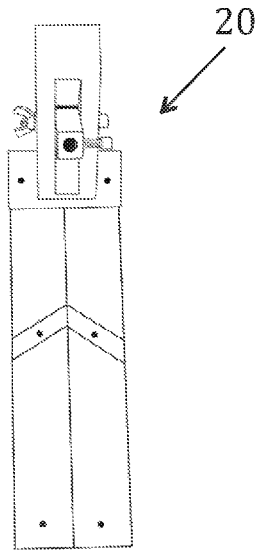
Figure 6:
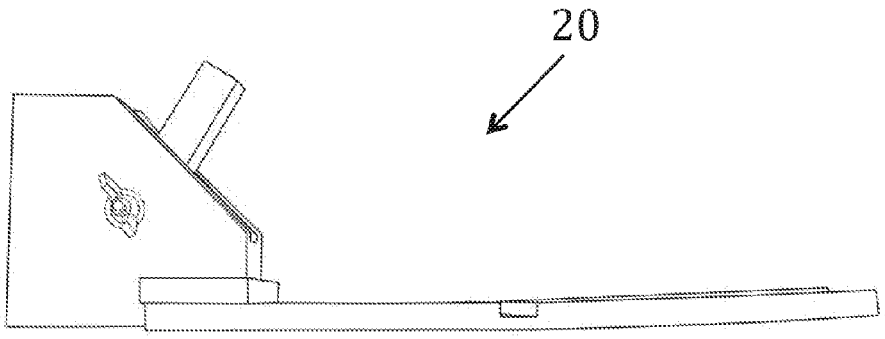
Figure 7:
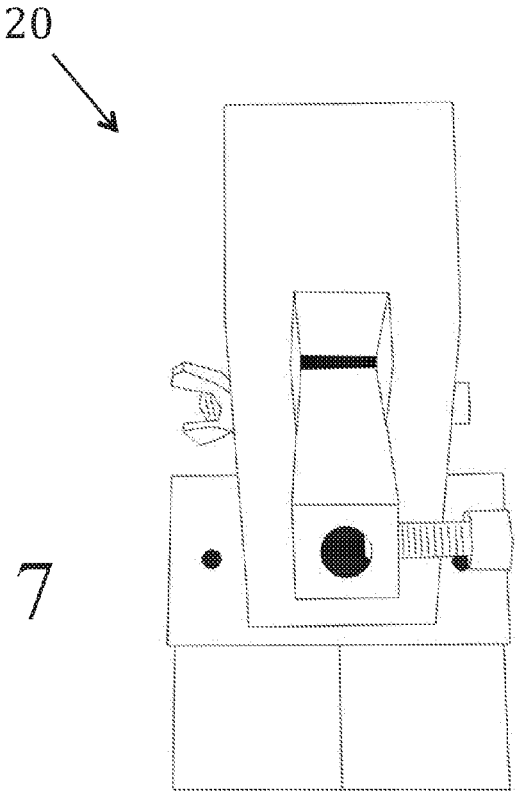
FIG. 7 is a photo of alignment rod holder piece of the alignment rod holder shown in FIG. 4.
Figure 8:
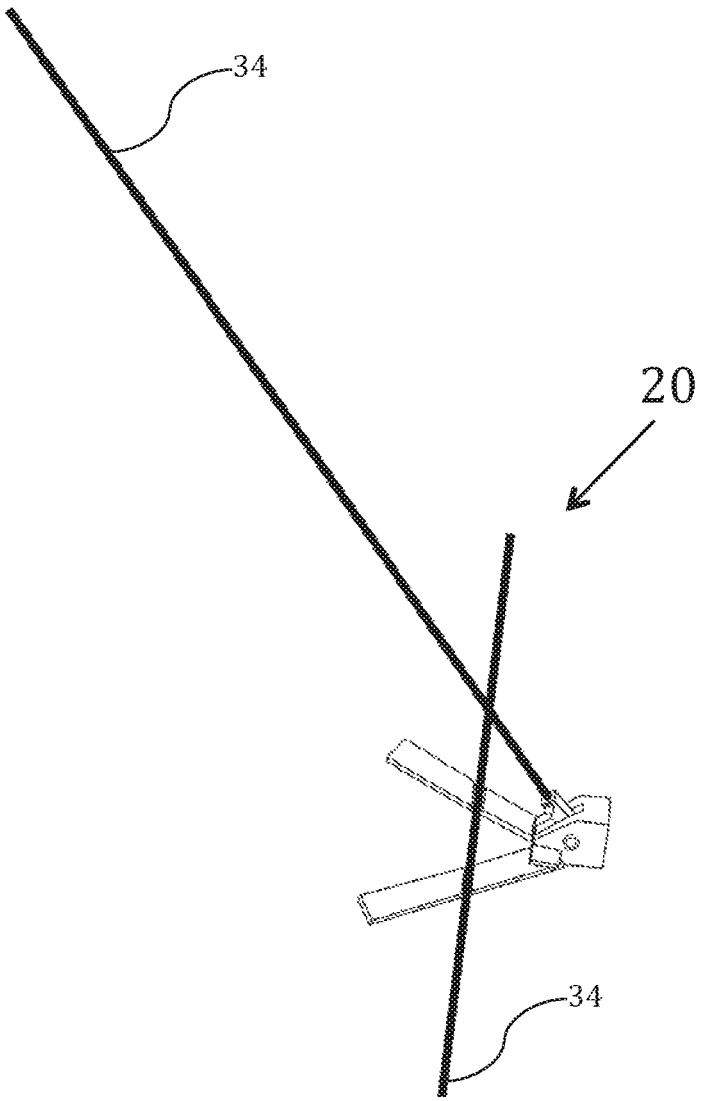
FIG. 8 is a photo of the alignment rod holder shown in FIG. 4 in a setup position for a golf drill.

In FIGS. 1 and 2, an alignment rod holder 10 is represented. The golf alignment device 10 is comprised of a base piece 12, a left arm 14 and a right arm 16. The left arm 14 is attached to the underside of the base piece 12 with a rotatable connection 18. The right arm 16 is attached in the same manner and location as the left arm 14 except on the opposite end of the base piece 12. The rotatable connection 18 is achieved with a screw. However, other embodiments have different ways of attaching the left arm 14 and right arm 16 to the base piece 12, such as a rivet or any other way that works in a manner consistent with this disclosure. At least one through hole 30, in this case seven 30*a-g*, is provided in the base piece 12. The through holes 30 are angled to allow an alignment rod 34 to be inserted into the base piece 12 at different angles. However, other embodiments have different ways of holding the alignment rod 34 at different angles, such as shown in FIG. 4 or any other way that works in a manner consistent with this disclosure. The left arm 14 and right arm 16 have notches 32 cut in them to allow an alignment rod to be inserted into them when the left arm 14 and right arm 16 are fully open. Other embodiments have multiple notches or no notches at all.

Referring to FIG. 2 the alignment rod holder 10 from FIG. 1 is shown with the left arm 14 and right arm 16 collapsed.

Figure 3:
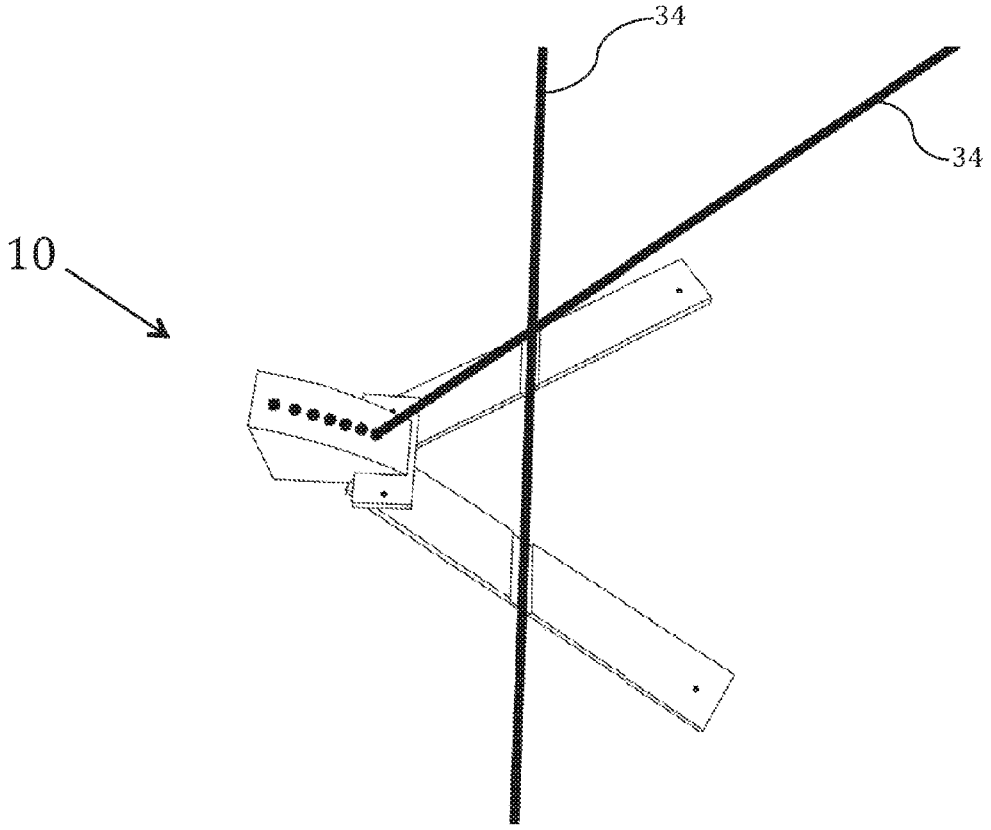
FIG. 3 is a photo of the alignment rod holder shown in FIG. 1 with an alignment rod inserted into a base piece hole and another alignment rod in the notches of the legs.

Referring to FIG. 3 the alignment rod holder 10 from FIG. 1 is shown with an alignment rod 34 inserted into the base piece 12 and another alignment rod 34 in the notches of the left arm 14 and right arm 16.

The alignment rod holder 10 may be made of any suitable material such as a high-strength plastic or of any other sufficiently rigid and strong material. It is presently preferred that alignment rod holder 10 be made of a high strength plastic, or similar material, so that if a golfer accidently hits the alignment rod holder 10, the likelihood of damage to his/her golf club and/or the alignment rod holder 10 is reduced.

Referring to FIG. 4-8 another alignment rod holder is shown 20. The alignment rod holder 20 is comprised of a base piece 22, a left arm 24, a right arm 26, and a rotating alignment rod holder 28. The rotating alignment rod holder 28 can be tightened, using a first screw 36 in one embodiment, to be fixed at various angles. The rotating alignment rod holder 28 has a second screw 38 that can be tightened to securely hold an alignment rod 34 in the alignment rod holder 28. However, other embodiments have different ways of holding the alignment rod 34, such as a clasp or any other manner that is consistent with this disclosure.

Figure 9:
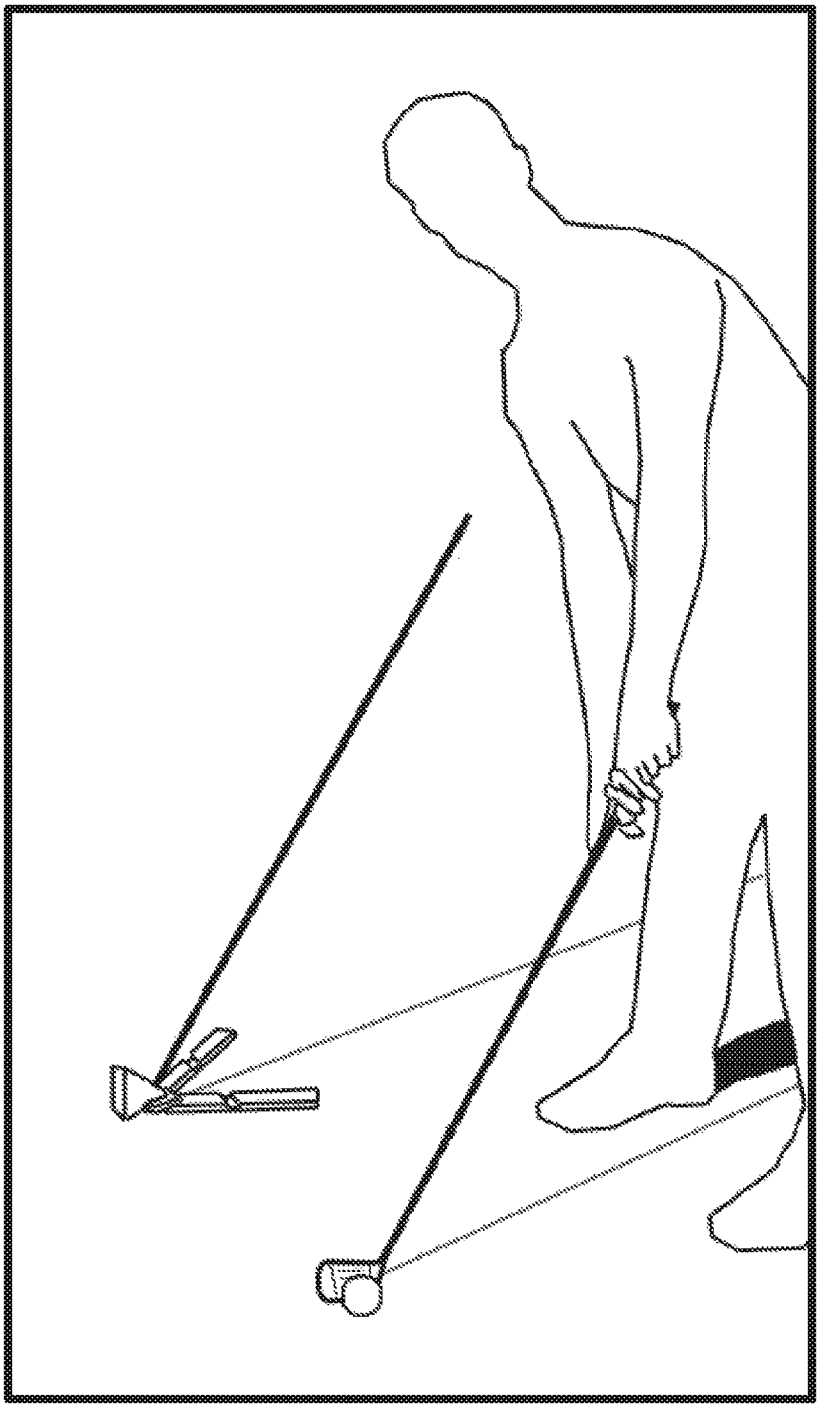
FIG. 9 is a photo of the alignment rod holder shown in FIG. 1 being used by a golfer.

Referring to FIG. 9, a golfer is setup using the alignment rod holder 10 to check his swing plane on the backswing.

Figure 10:
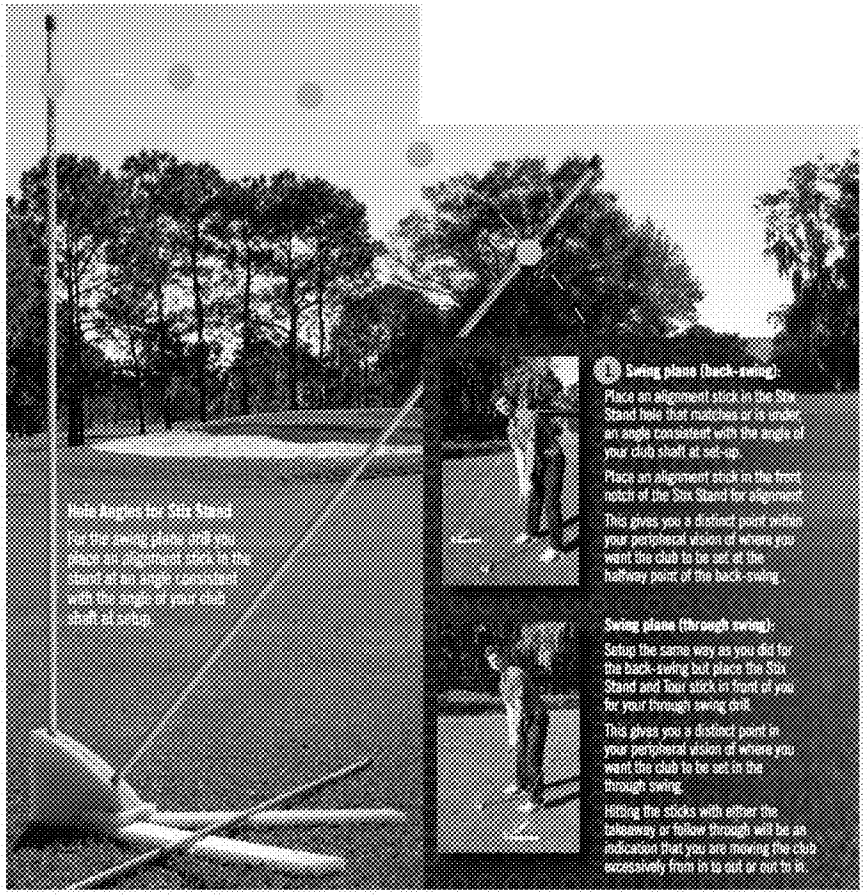
FIG. 10 is a description of how to perform various drills using the alignment rod holder shown in FIG. 1 and FIG. 4.

Referring to FIG. 10, various drills that can be performed with an alignment rod holder 10, 20 are shown. These are only a few drills and a golfer is not limited to only these drills.

Broadly, embodiments of the invention relate to a golf alignment rod holder that holds an alignment rod at different angles to provide a reference guide for performing various golf drills.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. An alignment rod holder comprising:

a base having a plurality of holes, each of the plurality of holes being configured to receive an alignment rod therein, each of the plurality of holes being positioned to angle an alignment rod inserted therein at a different angle relative to horizontal;

first and second arms rotatably connected to the base, wherein the base is centrally located between the first and second arms and the first and second arms are adjustable between a collapsed configuration and a fully-open configuration, each of the first and second arms having an alignment rod attachment configured to receive an alignment rod therein when the first and second arms are in the fully-open configuration.

2. The alignment rod holder of claim 1, wherein the base, first and second arms are made of plastic.

3. The alignment rod holder of claim 1, wherein the arms are rotatably connected to the base by a screw.

4. The alignment rod holder of claim 1, wherein the arms are rotatably connected to the base by a rivet.

5. The alignment rod holder of claim 1, wherein the alignment rod attachments of the first and second arms are notches.

6. The alignment rod holder of claim 1, wherein an alignment rod is attached to the base via one of the plurality of holes at an angle between 0 and 90 degrees relative to horizontal.

7. The alignment rod holder of claim 6, wherein the alignment rod attachment on each of the first and second arms are aligned along a common axis.

8. The alignment rod holder of claim 6, wherein the base, first and second arms are made of plastic.

9. The alignment rod holder of claim 6, wherein the arms are rotatably connected to the base by a screw.

10. The alignment rod holder of claim 6, wherein the arms are rotatably connected to the base by a rivet.

11. The alignment rod holder of claim 6, wherein each of the alignment rod attachments of the first and second arms is a notch.

12. The alignment rod holder of claim 1, wherein an alignment rod is within the alignment rod attachments of the first and second arms.

13. An alignment rod holder comprising:

a base having a guide channel with an alignment rod holder pivotally mounted therein, the alignment rod holder configured to receive an alignment rod and position the alignment rod at an angle between 0 and 90 degrees relative to horizontal;

a first arm having a first end and a second end, the first arm being rotatably connected at the first end to a bottom surface of the base and having an alignment rod attachment disposed between the first and second ends;

a second arm having a first end and a second end, the second arm being rotatably connected at the first end to the bottom surface of the base and having an alignment rod attachment disposed between the first and second ends, wherein the base is centrally located between the first and second arms;

wherein the first and second arms are adjustable between a collapsed configuration and a fully-open configuration, and the base is centrally located between the first and second arms.

14. The alignment rod attachment on the base of claim 13, wherein the pivoting alignment rod holder can be fixed at a desired angle by a screw.

15. The alignment rod attachment on the base of claim 13, wherein the pivoting rod holder can be fixed at a desired angle by a clamp.

* * * * *